US008887961B2

(12) United States Patent
Bax et al.

(10) Patent No.: US 8,887,961 B2
(45) Date of Patent: Nov. 18, 2014

(54) TAPPING DEVICE, BEVERAGE CONTAINER, COUPLING DEVICE AND METHOD WITH CLEANING ELEMENT

(75) Inventors: Bart Jan Bax, Blaricum (NL); Helmut Paulitsch, Graz (AT); Ernst Jan Folkert Van Der Wal, The Hague (NL); Antonius Maurits Willemen, Utrecht (NL)

(73) Assignee: Heineken Supply Chain B.V., Amsterdam (NL)

( * ) Notice: Subject to any disclaimer, the term of this patent is extended or adjusted under 35 U.S.C. 154(b) by 1559 days.

(21) Appl. No.: 12/305,962

(22) PCT Filed: Jun. 29, 2007

(86) PCT No.: PCT/NL2007/050322

§ 371 (c)(1),
(2), (4) Date: Jun. 9, 2010

(87) PCT Pub. No.: WO2008/002143

PCT Pub. Date: Jan. 3, 2008

(65) Prior Publication Data

US 2010/0243676 A1 Sep. 30, 2010

(30) Foreign Application Priority Data

Jun. 30, 2006 (NL) ..... 1032098

(51) Int. Cl.

| | |
|---|---|
| ***B67D 1/08*** | (2006.01) |
| ***B67D 1/07*** | (2006.01) |
| ***B08B 9/055*** | (2006.01) |

(52) U.S. Cl.

CPC ..... *B67D 1/07* (2013.01); *B08B 9/0552* (2013.01)

USPC ..... 222/148; 222/1; 222/399; 222/400.7; 15/3.5; 15/3.52; 15/104.03; 15/104.061; 15/104.062

(58) Field of Classification Search

USPC ..... 222/148–149, 151, 399, 400.7, 1; 137/212; 15/3.5, 3.52, 104.03, 15/104.061, 104.062; 239/310

See application file for complete search history.

(56) References Cited

U.S. PATENT DOCUMENTS

| | | | | |
|---|---|---|---|---|
| 2,331,460 | A * | 10/1943 | Davis | 137/239 |
| 4,607,410 | A * | 8/1986 | Bersch | 15/3.51 |
| 4,653,134 | A * | 3/1987 | Ando | 15/3.51 |

(Continued)

FOREIGN PATENT DOCUMENTS

| | | |
|---|---|---|
| BE | 1 004 880 A4 | 2/1993 |
| DE | 33 47 003 A1 | 7/1985 |

(Continued)

*Primary Examiner* — Frederick C Nicolas

(74) *Attorney, Agent, or Firm* — Pearne & Gordon LLP

(57) ABSTRACT

Tapping device for beverage, including at least one beverage container, a tapping line and a tapping cock, wherein the tapping line extends at least to adjacent the tapping cock and a connector for connection of the tapping line to the at least one beverage container, wherein a cleaning element is provided in the beverage container or the connector, which cleaning element upon broaching of a beverage container is situated near an end of the tapping line proximal to the beverage container and is movable through the tapping line under pressure of beverage from the beverage container, while abutting against an inner side of the tapping line, such that beverage will propel the cleaning element in the tapping line, at least to near the tapping cock.

24 Claims, 21 Drawing Sheets

(56) References Cited

U.S. PATENT DOCUMENTS

Figure 1:
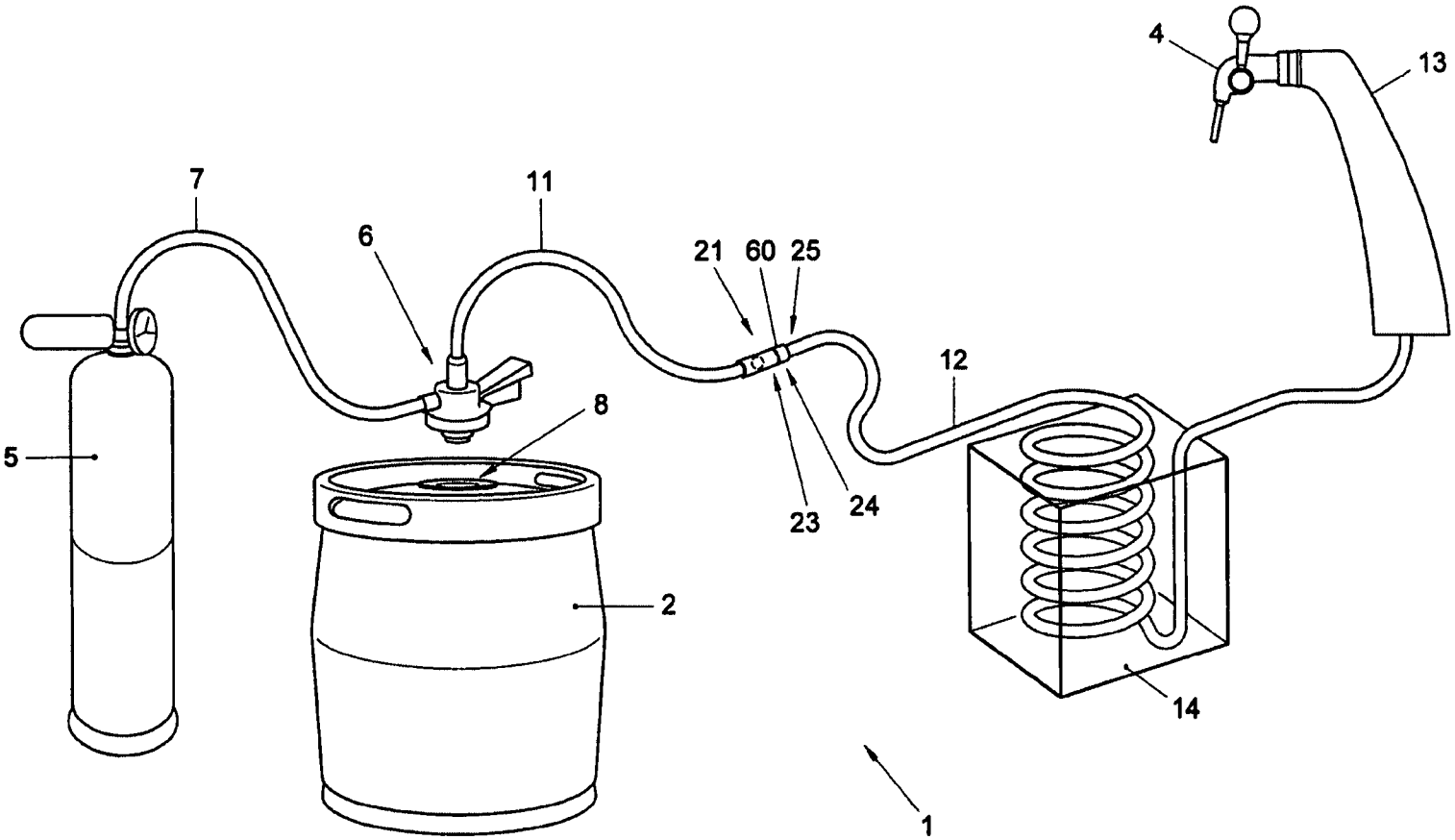

| | | | | | |
|---|---|---|---|---|---|
| 4,955,100 | A | * | 9/1990 | Bersch | 15/3.51 |
| 5,072,476 | A | * | 12/1991 | Bersch | 15/3.51 |
| 5,088,517 | A | * | 2/1992 | Bersch | 137/101.11 |
| 5,095,572 | A | * | 3/1992 | Wagner | 15/3.51 |
| 5,368,205 | A | * | 11/1994 | Groh | 222/189.06 |
| 5,442,826 | A | * | 8/1995 | Murata et al. | 15/3.51 |
| 5,444,886 | A | * | 8/1995 | Takashina et al. | 15/3.51 |
| 5,503,179 | A | * | 4/1996 | Till | 137/240 |
| 6,264,119 | B1 | * | 7/2001 | Truong | 239/310 |

FOREIGN PATENT DOCUMENTS

| | | | | | |
|---|---|---|---|---|---|
| DE | 9113488 | U1 | | 2/1992 | |
| DE | 4312516 | A1 | * | 10/1994 | B67D 1/07 |
| DE | 19542840 | A1 | | 5/1997 | |
| EP | 0 437 733 | A1 | | 7/1991 | |
| WO | 0248019 | | | 6/2002 | |
| WO | 02079075 | A2 | | 10/2002 | |

* cited by examiner

TAPPING DEVICE, BEVERAGE CONTAINER, COUPLING DEVICE AND METHOD WITH CLEANING ELEMENT

The invention relates to a tapping device. The invention relates, in particular, to a tapping device for tapping beverage, in particular carbonated beverage and/or beverage with natural ingredients, such as beer.

Tapping devices for tapping beverage such as beer are generally known and are used, for instance, in hotel, bar and restaurant establishments. In general, these tapping devices comprise a bar with a tapping column thereon, through which extends a tapping line which is coupled to a tapping cock on the tapping column. The opposite end of the tapping line extends, for instance, under the bar or at a distance from the bar, as in a cellar, refrigerator or outside. On the tapping line a connecting device is provided for coupling to a beverage container. Furthermore, to such a connecting device, often also a gas supply line is connected with which beverage in the beverage container can be pressurized. The connecting device can, for instance, be a handle tapping head when casks are used or a bayonet or screw connection when a cellar tank is used as beverage container.

During use, beverage is pressurized in the container such that upon opening of a beverage valve, the beverage is pressed, under pressure, via the connecting device into the tapping line and therethrough, to the tapping cock. Therefore, when the tapping cock is opened, the beverage will flow out. When the container has been emptied, the connecting device is uncoupled and a new container can be coupled, in practice also referred to as "broached".

One of the problems occurring with such tapping devices is that the tapping line, the tapping cock and the connecting device come in direct contact and remain in direct contact with the beverage during the time a container is broached. As a result, these parts become contaminated and contamination of the beverage may occur. Therefore, in particular when broaching a new container, or when the beverage has been stagnant in the beverage line for some time, it is of great importance that these parts be cleaned. If especially the lines and connecting devices are not cleaned properly, for instance deposit and bacteria can be formed in the lines, connecting device and tapping cock, whereby the quality of the beverage is adversely affected and even health hazards could be entailed.

A known manner of cleaning is flushing the tapping line with water after uncoupling the connecting device from a container, whereby residual beverage in the tapping line is discharged, whereupon a flushing liquid, typically water with a cleaning agent, is fed through the line. This has as a result that relatively much beverage is lost, in particular with long tapping lines. Also, with the flushing liquid a small sponge may be carried along through the tapping line, in practice referred to as pig. With this, the inside of the tapping line can be cleaned. A drawback of such a method is further that it is time consuming to carry out such cleaning. Furthermore, this takes relatively much water and flushing liquid per cleaning operation, in particular because after the flushing liquid has been fed through, the lines are to be rinsed with clean water before beverage can be fed through again.

The invention has a number of objects which can be achieved both individually and in combination with at least one of a tapping device, method, coupling element and container, as well as other aspects of the invention.

One object of the invention is to provide a tapping device for beverage which allows simple cleaning.

Another object of the invention is to provide a tapping device with which, during normal use, loss of beverage can be minimized.

A further object of the invention is to provide a tapping device where cleaning takes relatively little time.

Furthermore, an object of the invention is to provide a method with which cleaning of a tapping device is possible in a relatively simple manner and/or takes relatively little time and/or is accompanied by relatively small loss of beverage and/or cleaning liquid and/or water.

At least one of these and other objects are achieved individually or together with other objects with a tapping device, method, container, coupling element and/or connecting device according to the invention.

In a first aspect, the invention can be characterized in that a tapping device is provided with a cleaning element on the container or connecting means for the container, which cleaning element, upon broaching of a container, is located near a first end of the tapping line proximal to the container, and is movable through the tapping line under pressure of beverage from the container. Here, the cleaning element abuts against an inside of the tapping line such that beverage cannot pass the cleaning element in the tapping line. The cleaning element is removable adjacent an opposite, second side of the tapping line.

With such a device, with a new container, automatically a cleaning element is fed through the tapping line in a manner such that the inside thereof is cleaned. The cleaning element can be taken directly from the line, in or near the tapping cock. As the beverage is used for propelling the cleaning element, virtually no beverage is lost.

Surprisingly, it has appeared that a tapping device can thus be utilized for a long period of time without intervening cleaning operations being required according to the state of the art described in the introduction. Furthermore, cleaning with a cleaning element according to the invention cannot be forgotten.

It will be clear that such a device can be used with any type of container, with an external supply of a pressure medium, such as gas, as well as with an internal source for pressurizing the beverage. The device can also be used with other beverage containers such as compressible containers, containers that are emptied through reduced pressure or through suction by a dispensing hose or the like.

In a second aspect, the invention can be characterized in that a container is coupled to a tapping line by means of a connecting device, whereby upon coupling of the connecting device to the container, a coupling element with a beverage passage is included between the inside space of the container and the tapping line. A cleaning element which, during coupling, extends in or at the coupling element will, after opening of a beverage valve of the container, be forced by beverage from the container into and through the tapping line and be removed at an end of the tapping line.

With such a method, cleaning is possible in a simple manner.

The invention can further be characterized by a coupling element for use in a tapping device, which coupling element comprises a beverage passage, in or at which beverage passage a cleaning element is provided which can be pressed, during use, from the coupling element into a beverage line coupled thereto by liquid introduced into the beverage passage, in particular beverage from a container connected thereto.

The invention can further be characterized by a container, wherein the container is provided with a valve assembly for dispensing beverage, adjacent which valve assembly a cleaning element is provided in a beverage passage, such that upon opening of the valve assembly, beverage is introduced from the container into the beverage passage, thereby moving the cleaning element away from the valve assembly.

The invention can further be characterized in that a beverage container with a valve assembly is provided, or at least a valve assembly for a beverage container, wherein adjacent, in or on the valve assembly, a cleaning element is provided in a beverage passage, in a manner such that upon feed-through of beverage through the valve assembly, the cleaning element is moved away from the valve assembly. In an alternative embodiment, a beverage valve of the valve assembly is formed, at least partly, by the cleaning element.

Figure 2:
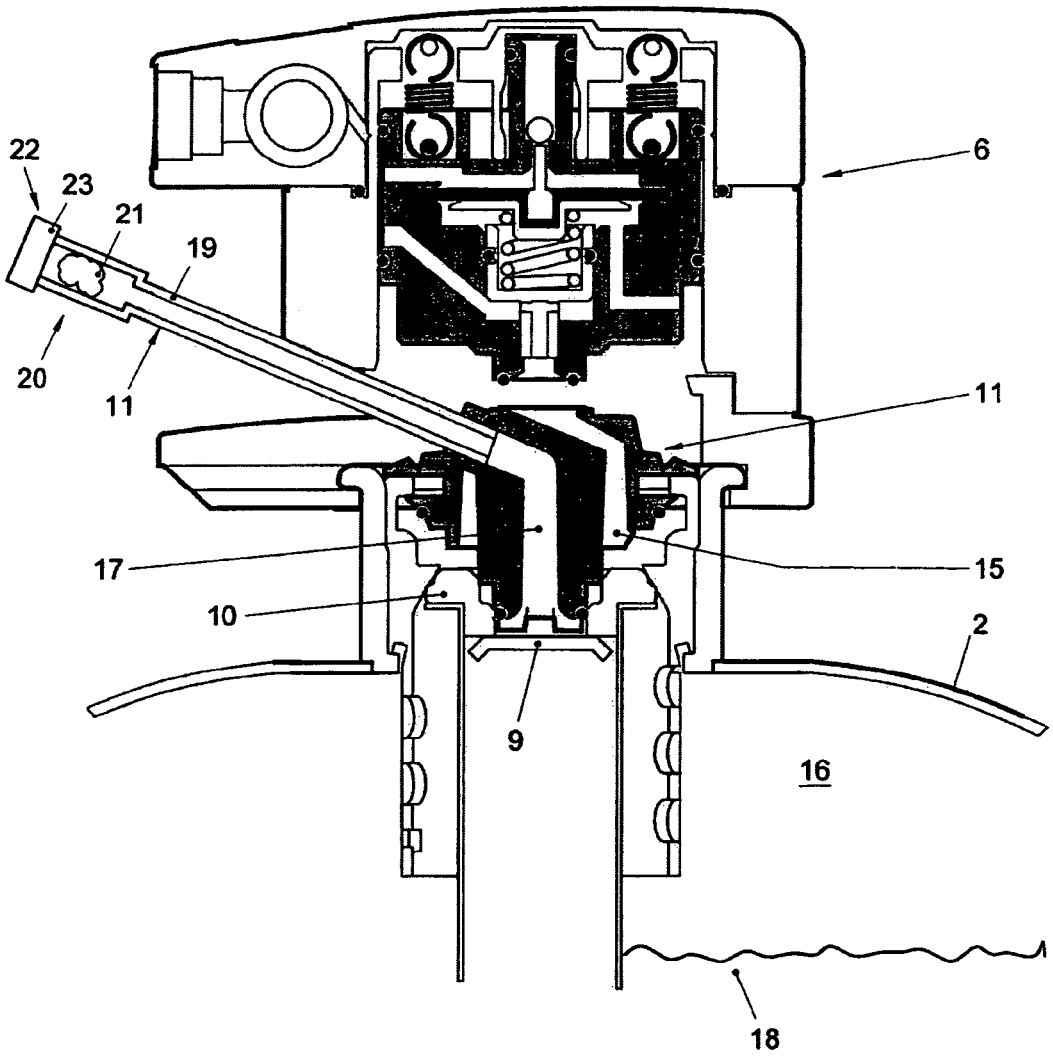
Figure 3:
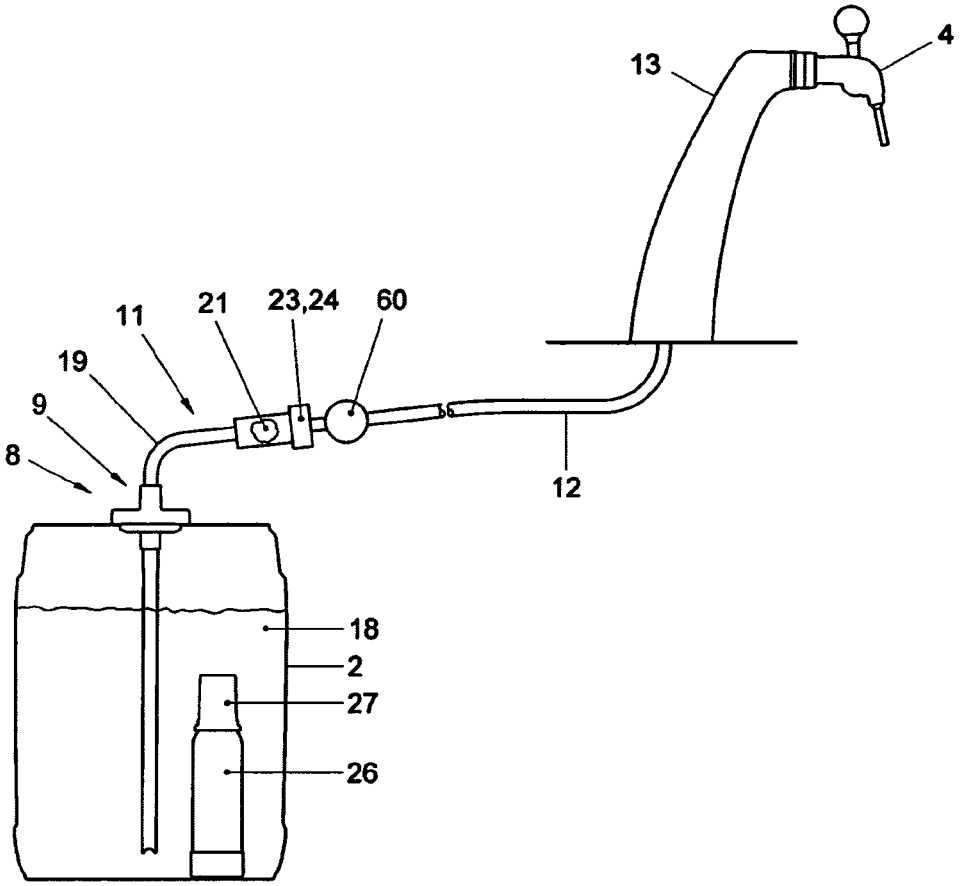
Figure 4:
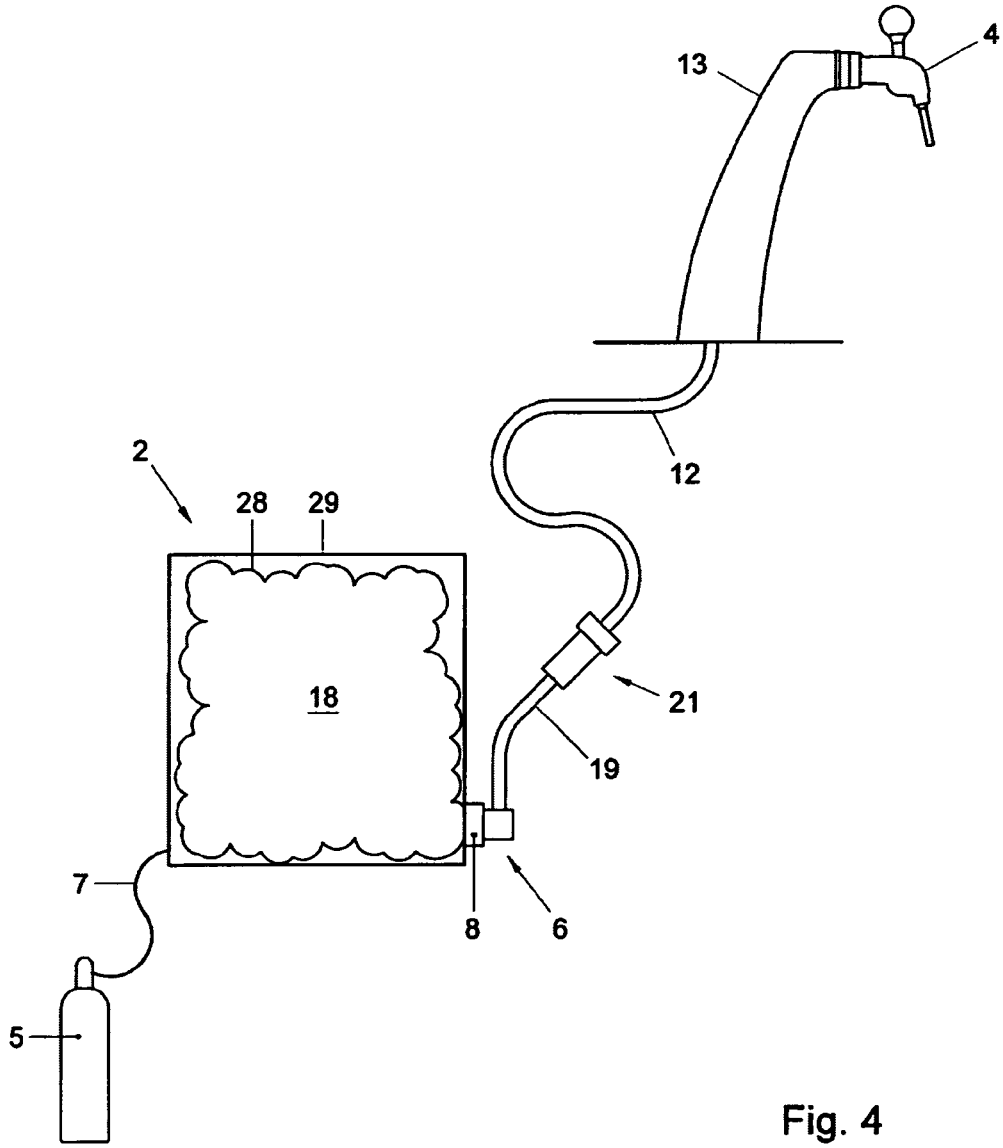
Figure 5:
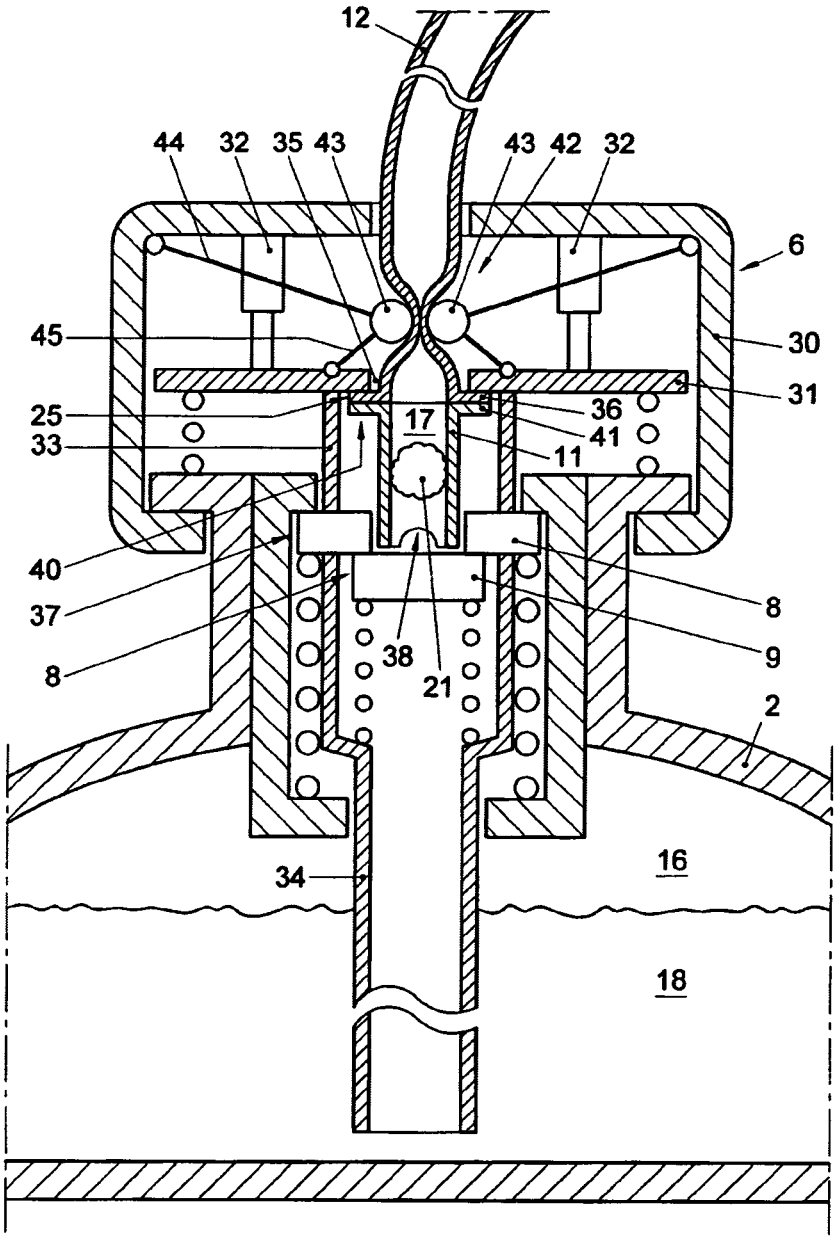
Figure 6:
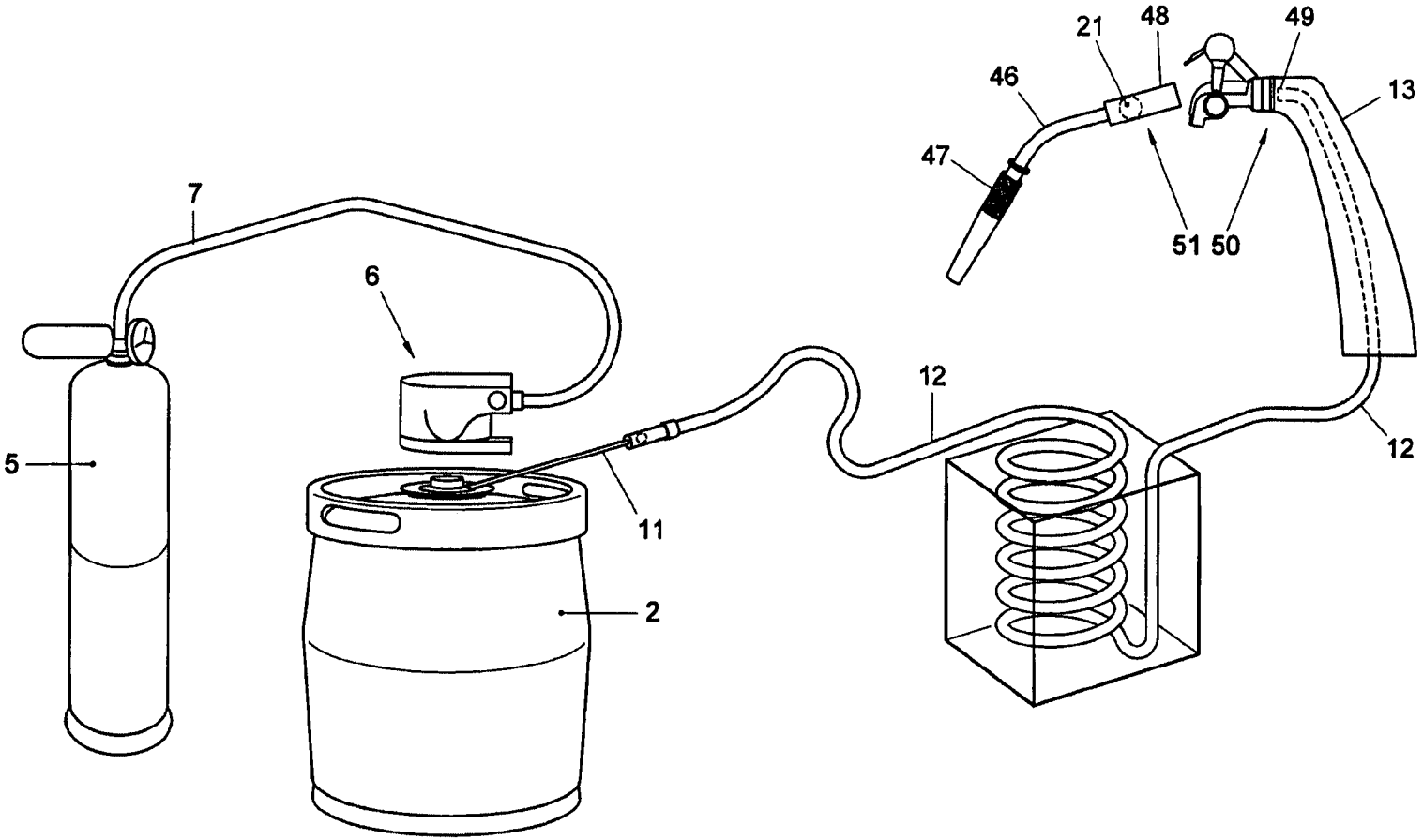
Figure 7A:
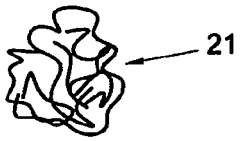
Figure 8:
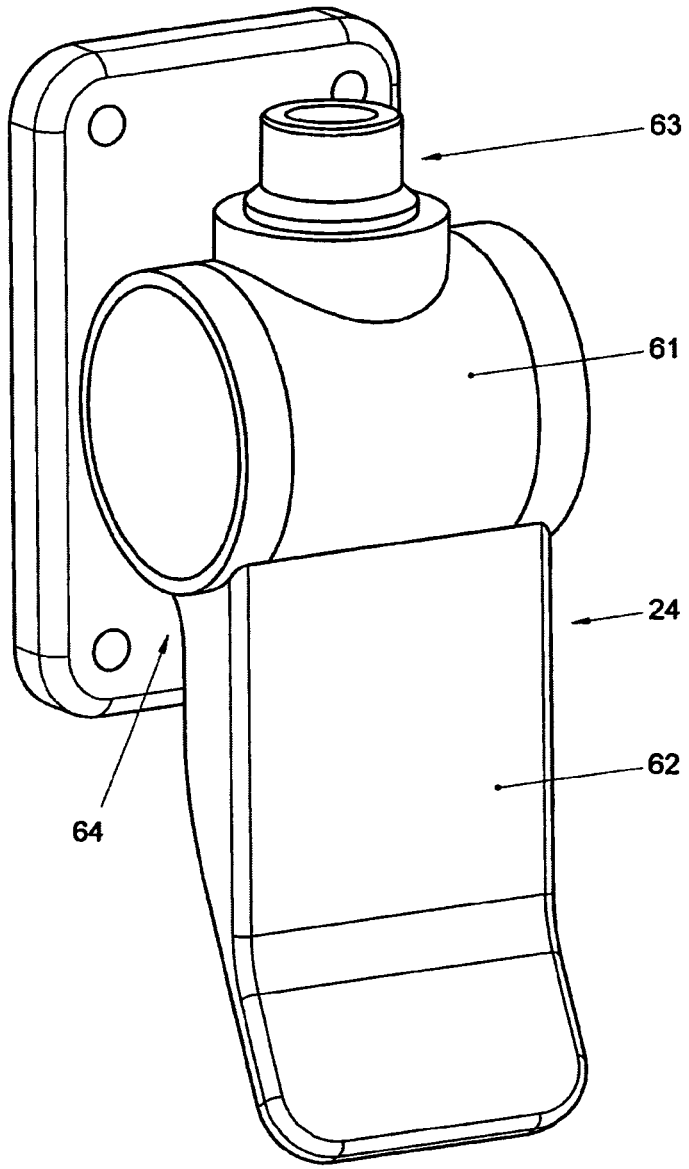
Figure 9A:
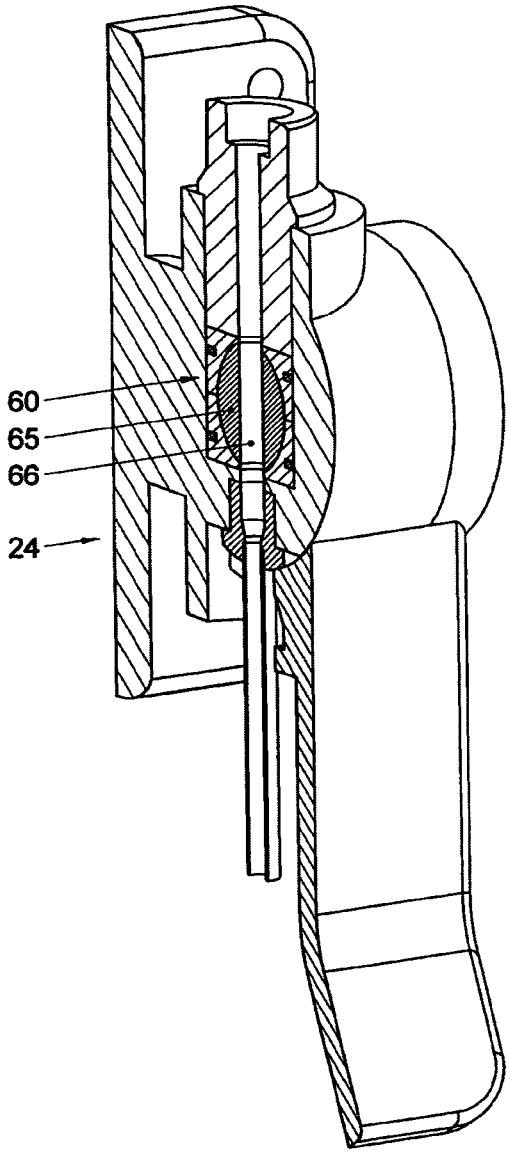
Figure 9B:
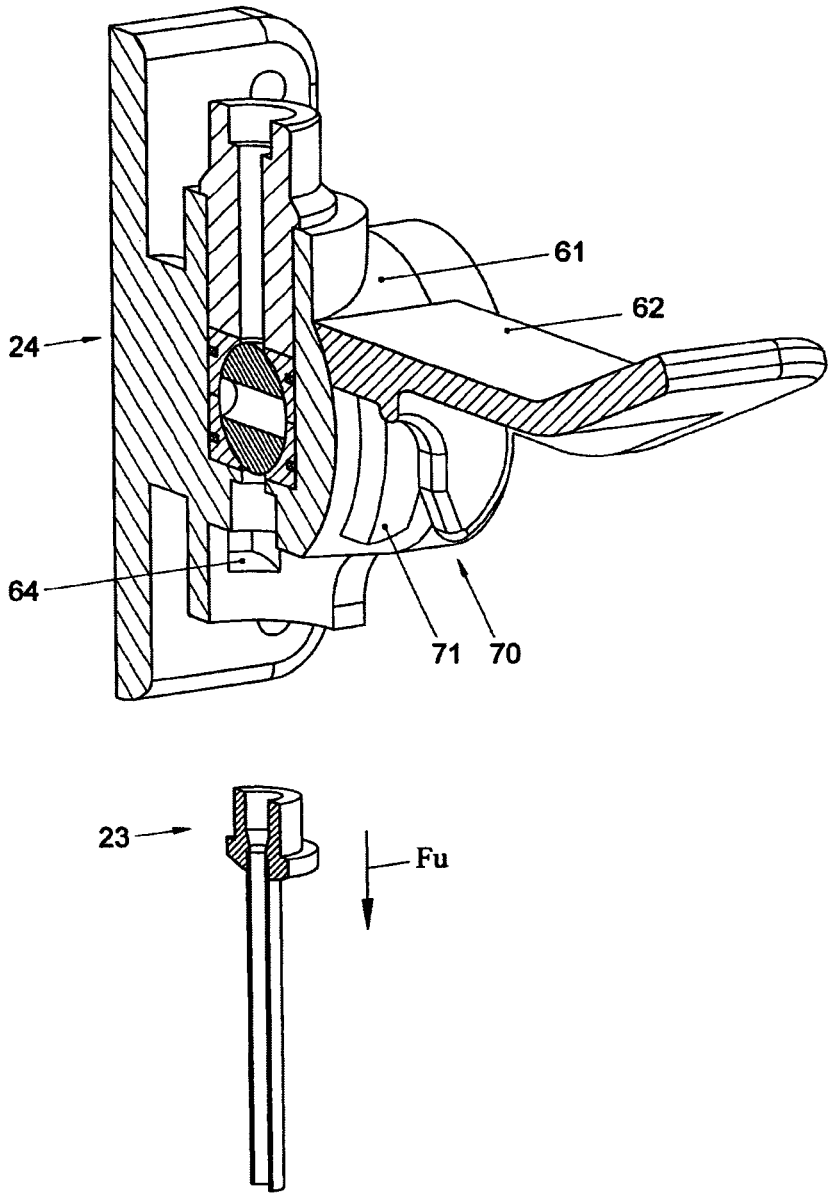
Figure 9C:
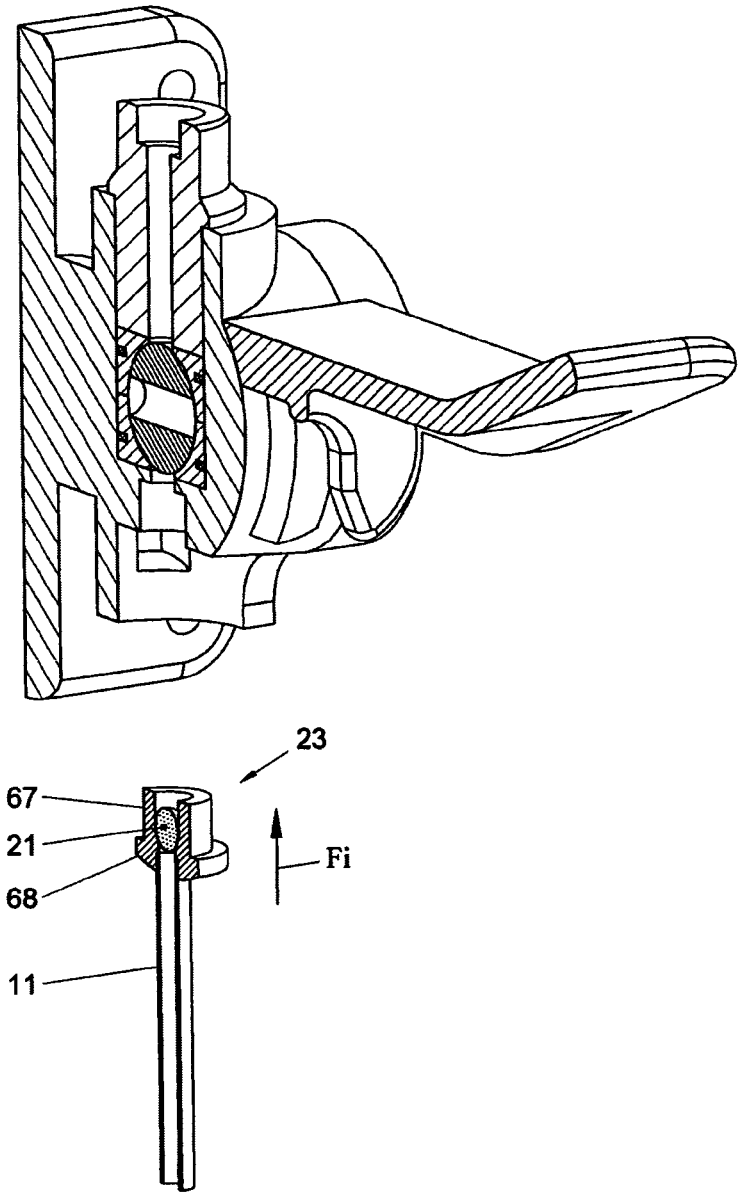
Figure 9D:
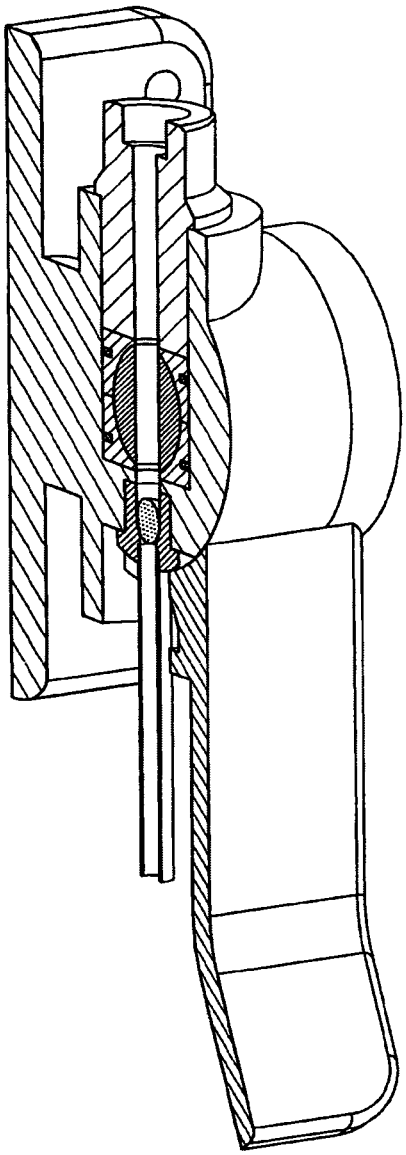
Figure 10:
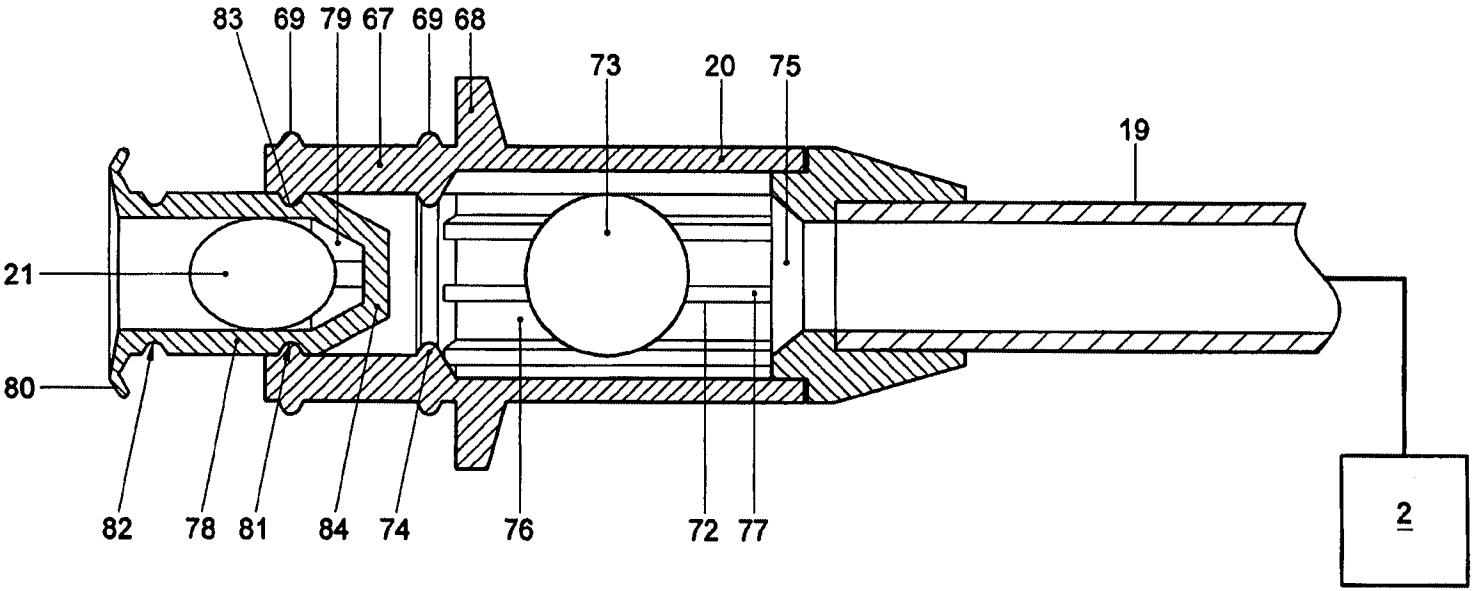
Figure 12:
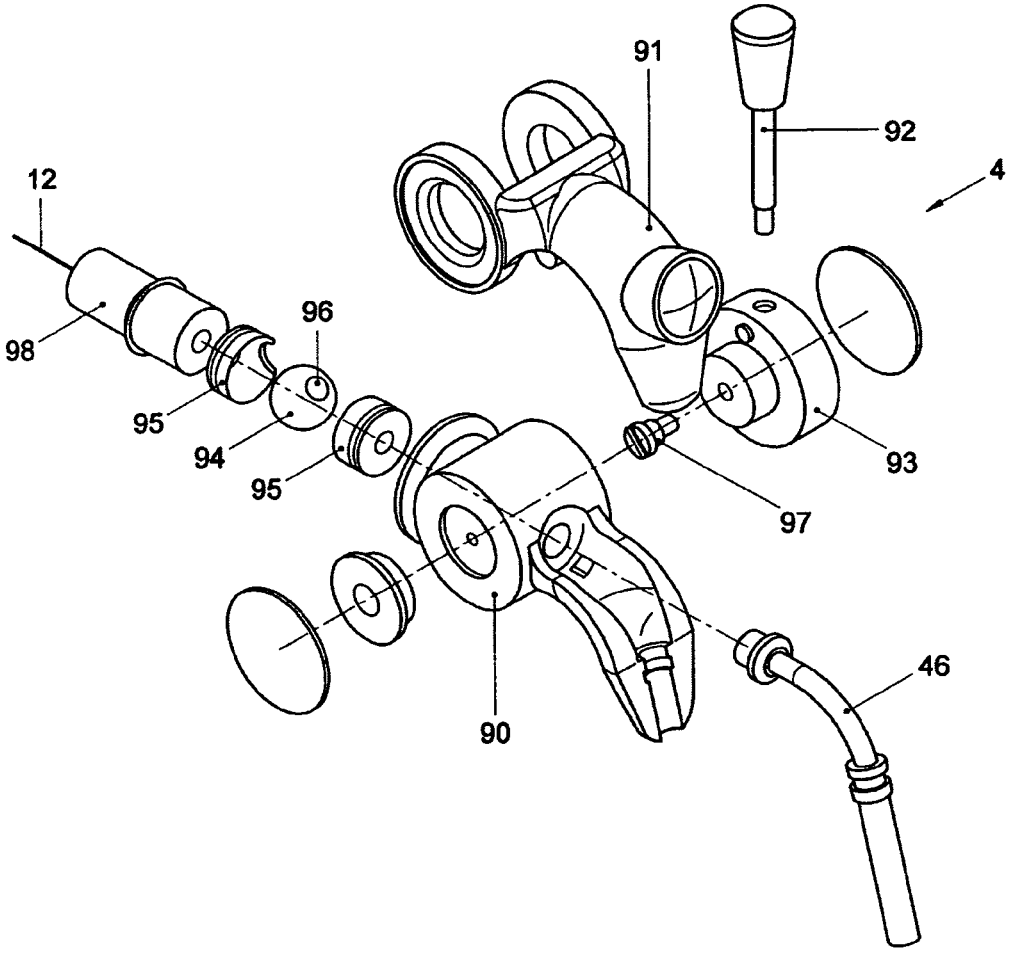

In clarification of the invention, embodiments of different aspects of the invention will be further elucidated with reference to the drawing. In the drawing:

FIG. 1 schematically shows a tapping device according to the invention;

FIG. 2 schematically shows a coupling element according to the invention;

FIG. 3 schematically shows an alternative embodiment of a tapping device according to the invention;

FIG. 4 schematically shows a further alternative embodiment of a tapping device according to the invention;

FIG. 5 schematically shows an alternative embodiment of a coupling element according to the invention;

FIG. 6 shows an inlay element for a tapping device according to the invention;

FIGS. 7A and B show two embodiments of a cleaning element according to the invention;

FIG. 8 shows a perspective view of a coupling means;

FIGS. 9A-D show in partial cross section an uncoupling and coupling of a coupling element to a coupling means;

FIG. 10 shows a portion of a coupling element with cleaning element;

FIGS. 11A-D show four steps in the connection of such a coupling element;

FIG. 12 shows, in exploded view, a tapping cock;

FIGS. 13A-D show four steps in the connection of an insert part; and

Figure 14B:
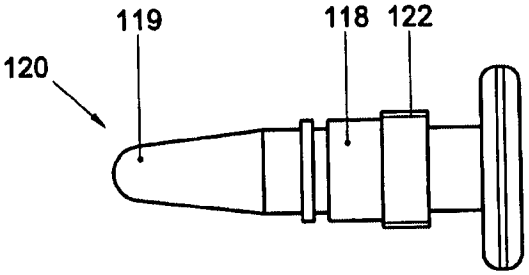
Figure 14A:
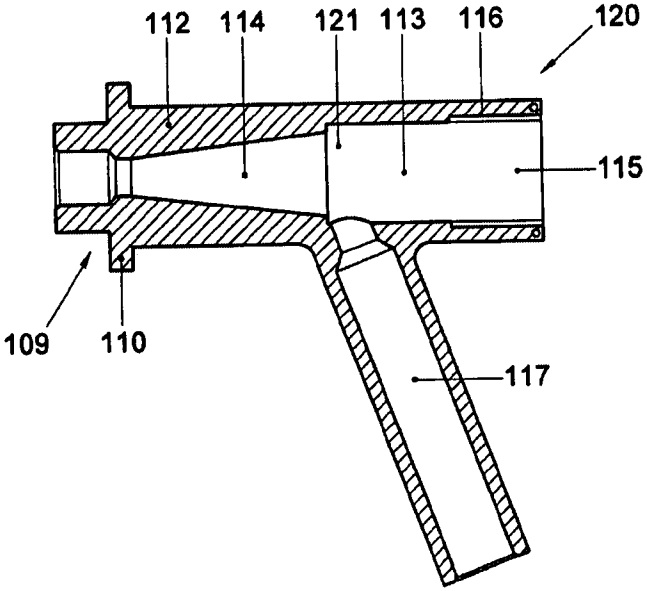

FIG. 14 shows a regulator.

The embodiments shown in the drawing and described in the following are shown merely by way of illustration and should not be construed to be limitative in any manner. Combinations of embodiments and parts thereof are understood to have been incorporated and represented herein.

In FIG. 1, a tapping device 1 according to the invention is shown, which comprises a beverage container 2, a tapping cock 4 and a pressure medium source 5, in particular a $CO_2$ cylinder. With the aid of a connecting device 6, conventionally also referred to as handle tapping head or dispense had, a gas line 7 is connected to the beverage container 2. As shown in, for instance, FIGS. 2 and 5, the beverage container 2 can be provided with a conventional valve assembly 8, which comprises at least a beverage valve 9 and optionally also a gas valve 10. With the aid of the connecting device 6 and possibly a coupling element 11 to be further described, at least the beverage valve 9 and, when present, the gas valve 10 can be opened. Suitable connecting devices are described in WO 02/079075 and WO 02/048019, which publications are understood to be incorporated herein by reference as to the structure and operation of suitable handle tapping heads, dispense heads and other connecting devices 6. A tapping line 12 extends from the tapping cock 4 in the direction of the connecting device 6, which tapping line 12 can extend, for instance, through a tapping column 13 on which the tapping cock 4 is arranged, and an in-line cooler 14 or a python.

In the embodiment shown in FIG. 1, the coupling element 11 is attached directly to the upper side of the connecting device 6, at the location where the tapping line is normally connected to such a handle tapping cock 6. Naturally, the coupling element can also extend through the connecting device 6 as the handle tapping head, such that there is no contact between the beverage and the connecting device 6.

In each of the embodiments shown, the coupling element 11 can be disposable, suitable and/or intended for once-only use. Also, it may already be disposed on a valve assembly of a beverage container 2 at delivery thereof, and later be removed again along with the beverage container 2, or separately therefrom.

In the embodiment shown in FIG. 2, on the valve assembly 8 of the beverage container 2, a coupling element 11 is provided with which both the beverage valve 9 and the gas valve 10 can be opened when it is pressed down with the aid of the connecting device 5. To that end, the connecting device is shown here as described in WO 02/079075, to which reference is made for its operation. In the coupling element 11, as shown in further detail in FIG. 2, a first passage 15 is provided for feeding through gas or a different suitable pressure medium from the pressure medium source 5 to the inside space 16 of the beverage container 2 and a second passage 17 for discharging beverage 10 from the inside space 16. To the second passage 17, a hose or tube 19 is connected, preferably somewhat flexibly. The hose or tube 19 is provided with a part 20 in which a cleaning element 21 is included, at least prior to the first feed-through of beverage 19 from a beverage container 2 with the respective coupling element 11. The cleaning element 21 is, for instance, a somewhat flexible, spherical or cylindrical element such as a sponge or plastic element, with dimensions such that a cross-section of the tapping line 12 is completely closed off thereby, and the cleaning element 21 abuts, in circumferential direction, against the inside of the tapping line. A free end 22 of the hose or tube 19 is provided with a first coupling means 23 that can cooperate with a second coupling means 24 at the corresponding end 25 of the tapping line 12. Thus, a liquid-tight connection is formed.

It will be clear that in a comparable manner, use can also be made of a beverage container 2 of the Bag-in-container type, wherein the beverage is included in, for instance, a flexible bag and a pressure medium, such as gas or liquid, is introduced between the bag and the wall of the container 2 for compressing the bag.

The cleaning element 21 is preferably somewhat flexibly compressible and has, in non-compressed form, dimensions that are such that it cannot be fed through a tapping line 12 without at least some compression, so that close contact can be obtained between the cleaning element and the tapping line. The cleaning element can be, for instance, substantially spherical, manufactured from, for instance, plastic or rubber, metal sponge, metal foam or other suitable materials, with a diameter that is slightly greater than the inside cross-section of the tapping line 12. The cleaning element can be completely non-moisture transmissive. The surface of the cleaning element can be smooth, but can also be provided with a profiling, for instance ridges, bumps, indentations or the like, for, for instance enhancing friction and/or increasing the contact surface, while then, furthermore, for instance cleaning agent, such as liquid, can be provided in for instance the profiling mentioned, for further improvement of the cleaning. Also, for instance a groove, for instance spiral-shaped, can be provided so that, owing to the liquid and/or the friction with the wall, the cleaning element is brought into, for instance, a rotating movement during feed-through through the tapping line.

In each of the embodiments shown, naturally, it can be provided that the container 2 and/or the tapping line 12 and/or the tapping column 13 are cooled. It has appeared that in particular if each of these parts is cooled, cleaning of the tapping device other than with the cleaning element 21, is necessary only sporadically, inter alia because growth of bacteria is virtually prevented. Also if no, or only one or two of the group of the container 2 and/or the tapping column 13 and/or the tapping line 12 is cooled, a large improvement is already obtained with respect to existing tapping devices.

A tapping device according to FIG. 1 or with a coupling element according to FIG. 2 can be used as follows.

A beverage container 2, filled with beverage 18, is delivered. A coupling element 11 can be delivered separately but is preferably provided on the valve assembly 8 in advance, for instance in the brewery or bottling plant. At the location of the tapping device 1, any previously used beverage container is uncoupled by a user through detachment of the connecting device 6 and detachment of the old coupling element 11 from the tapping line 12. Then the beverage container 2 is put in place and the new coupling element 11 is connected to the tapping line 12 with the aid of the coupling means 23, 24. Then the connecting device 6 is placed over the coupling element 11 onto the beverage container 2 and energized in a manner such that the beverage valve 9 and the gas valve 10 are opened. As a result, gas will flow into the inside space 16 and pressurize the beverage 18, so that beverage 8 will flow into the second passage 17, into the part 20 with the cleaning element 21. When the tapping cock 4 is opened, as a result of the pressure applied by the beverage from the beverage container 2 to the cleaning element, beverage in the tapping line together with the cleaning element 21 will be propelled through the tapping line 12 towards an outlet of the tapping cock. Here, the cleaning element 21 remains in constant, close contact with the inside of the tapping line 12. Preferably, the cleaning element has a somewhat rough or otherwise cleaning surface and can optionally be provided with a suitable coating. Cleaning coatings are generally known and a choice will be simple for the skilled person. After some time, the cleaning element 21 will be dispensed via the tapping cock and beverage 18 will be dispensed from the new beverage container 2.

With a tapping device 1 according to the invention, each time when a new coupling element 11 is used, a cleaning element 21 will be forced through the tapping line, thereby cleaning the inside of the tapping line so that deposit on the inside of the tapping line 12 is prevented. It is precisely such deposit which appears of great influence on the purity of the tapping line and hence the beverage. It has appeared that when using a tapping device according to the invention, a thorough cleaning of the tapping device 1, with the beverage supply shut down and the tapping device cleaned with flushing liquid and rinsed with water before it can be used again, is required much less frequently, which results in smaller sales losses and, furthermore, reduces the costs of such thorough cleaning operations.

With a tapping device 1 according to the invention, for cleaning the tapping line 12, the beverage 18 still present in the tapping line does not need to be discarded when connecting a new beverage container. The fact is that it is propelled by the beverage from the new beverage container 2 and can simply be consumed, at least for the larger part, and is separated from the new beverage 18 by the cleaning element, so that no mixing will occur. In order to prevent the beverage from flowing back from the tapping line 12 when a previously used coupling element 11 is uncoupled, preferably, a shutoff 60 is provided in or near the second coupling means 24 in the tapping line. This may be a cock or like shutoff and closes preferably automatically when the communication between the first and second coupling means 23, 24 is broken. Such couplings are generally known. Naturally, the communication can also be realized by for instance pressing part 8 onto the container 2.

FIG. 3 shows an alternative embodiment of a tapping device 1 according to the invention, wherein the beverage container 2 is provided with an internal pressure source, here in the shape of a container 26 filled with pressurized $CO_2$, on which a pressure regulator 27 is provided which regulates the supply of $CO_2$ from the container 26 on the basis of the pressure in the inside space 16 of the beverage container 2, so that the pressure in the inside space 16 is automatically maintained within predetermined boundaries, preferably at equilibrium pressure if carbonated beverage such as beer is used. In this embodiment, the coupling element 11 is designed with only the second passage 17 and means for attaching it to the beverage container 2, for instance to a collar thereof, when the valve assembly is opened.

FIG. 4 shows a further alternative embodiment of a tapping device 1 according to the invention, wherein the beverage container 2 has the form of a bag-in-container and is, for instance, a cellar beer installation tank or a beverage container wherein a pressure medium is used which is not contacted with the beverage. Here, a coupling element 11 is utilized comparable to that according to FIG. 2. Gas such as, for instance, air, however, is introduced between the inner container 28 and the outer container 29, whereby the inner container 28 is compressed and beverage included therein is pressed away when the beverage valve 9 is opened.

FIG. 5 shows an alternative embodiment of a coupling element 11, included between a connecting device 6 and a valve assembly 8 of a beverage container 2. The connecting device 6 comprises a housing 30 having therein a piston 31, which is movable in the direction F with the aid of, for instance, piston assemblies 32, although also other means can be utilized, such as a lever or screw means. At the underside of the piston 31, an edge 33 is provided with which the gas valve 10 can be pressed downwards, together with the riser 34. The edge 33 links up liquid-tightly with the gas valve. Through an opening 35 in the piston 31 extends a free end 25 of a tapping line 12, provided with a collar 36 abutting against the underside of the piston 31. Between the collar 36 and the beverage valve 9, the coupling element is included with the cleaning element 21 therein. The coupling element is substantially pipe-shaped with a passage 17, is provided, on a first side, with an edge 37 with openings 38 for pressing the beverage valve 9 downwards relative to the gas valve 10 and allowing beverage to pass from the beverage container 2 to the passage 17. The opposite end 40 has an outward projecting collar 41 which seals against the collar 36. Above the piston 31, a clamping mechanism 42 is provided with which the flexible part of the tapping line 12 can be pinched closed or released. Naturally, all sorts of clamping mechanisms can be utilized. Shown are two brackets 43, which are provided on either side of the tapping line 12 and which are each connected to the housing 30 via a first rod 44 and to the piston 31 via a second rod 45. When moving the piston 31 downwards, in the direction of the valve assembly 8, the brackets 43 are pulled apart, so that the tapping line 12 can be pressed open by the beverage, by the cleaning element 21 and/or the elasticity of the tapping line. When the piston 31 is moved back up, the brackets are moved together and the tapping line is clamped tight as shown in FIG. 5. This means that special connecting operations are not required while, upon detachment of the connecting device 6, the tapping line is directly closed, while the tapping line has no cavities or other irregularities where contaminations can deposit without the cleaning element being able to clean them. However, also a different type of shutoff can be used, for instance a cock, operated by the movement of the piston 31.

It can be advantageous to design the collar 36 such that it projects slightly into the tapping line and abuts against its inside. As a result, contamination of the transition is prevented even further.

It will be clear that the tapping rod 34 can be omitted, for instance if the neck of the container 2 is directed downwards.

Instead of the operating means 32, naturally, a manual operation of the piston 31 can be chosen as well, for instance by means of a conventional handle tapping head or like mechanism.

Optionally, the cleaning element 21 instead of the valve 9 can provide the sealing of the passage for beverage, so that, in effect, the cleaning element 21 forms the beverage valve 9. This can then be fed through the tapping line 12 and it is directly clear that the container is already open. Refilling the container is then impossible without a new cleaning element being provided.

In FIGS. 8 and 9, a possible embodiment of a coupling means 24 is shown. This coupling means 24 comprises a housing 61 and a handle 62 pivotable relative thereto. At the upper side shown in FIG. 8, a connecting opening 63 is provided in which an end 25 of a tapping line 12 can be or has been secured, for instance by clamping, a suitable coupling, gluing, welding or any other suitable manner. At the underside, a connecting opening 64 is provided in which a first coupling means 23 can be inserted, as will be further elucidated. In the housing 61, a shutoff 60 is provided, in the embodiment shown a ball valve without waste space around the ball 65 with passage 66 thereof. The ball 65 is connected with the handle 62, so that the ball, through pivoting of the handle 62, can be moved between a closing connecting position (FIGS. 9B and C) and a pass position of use (FIGS. 9A and D). The first coupling means 23 can for instance be designed as shown in FIG. 10. The first coupling means 23 comprises an insertion part 67 and a flange 68. The insertion part 67 can be inserted into the connecting opening 64 as far as the flange 68, while preferably the insertion part 67 and/or the connecting opening 64 are provided with sealing means 69 for a liquid-tight connection. The handle 62 is provided with locking means 70 such as a set of teeth 71 which in the position of use lock the flange 68 against the housing, and, upon pivoting of the handle to the connecting position, move along and release the flange, so that the insertion part 67 can be pulled away in axial direction $F_u$ and another coupling means 23 can be placed, by inserting the insertion part 67 thereof in axial direction $F_i$ into the connecting opening and thereupon pivoting the handle 62 back to the position of use, so that the teeth 71 again press the flange against the housing or otherwise lock the first coupling means 23 in or on the second coupling means 24. In the cross-section in FIG. 9C, schematically the cleaning element 21 is provided in the first coupling means 23, in particular in the insertion part 67.

Upon pivoting of the handle 62 from the position of use to the connecting position, the passage 66 is pivoted from a position in which it forms a fluid communication between the connecting element 11 and the tapping line 12, to a condition in which this fluid communication is broken. Beverage then cannot flow back from the tapping line 12. After a new connecting element 11 has been placed in the manner as indicated and described, the handle 62 is pivoted back and thereby, in principle, the fluid communication is restored, at least the passage 66 is brought in a position where beverage can flow from the tapping line 12 into the passage or vice versa, while the coupling means 23 is retained in the connecting opening and/or against the housing. In the position of use, the connection between the coupling means 23, 24 is covered by the handle 62, so that unintended detachment is prevent still better.

Figure 11A:
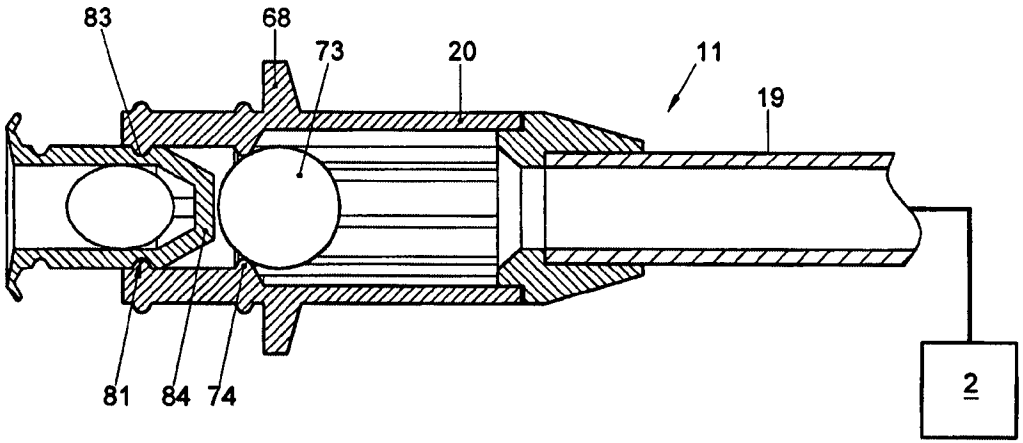
Figure 11B:
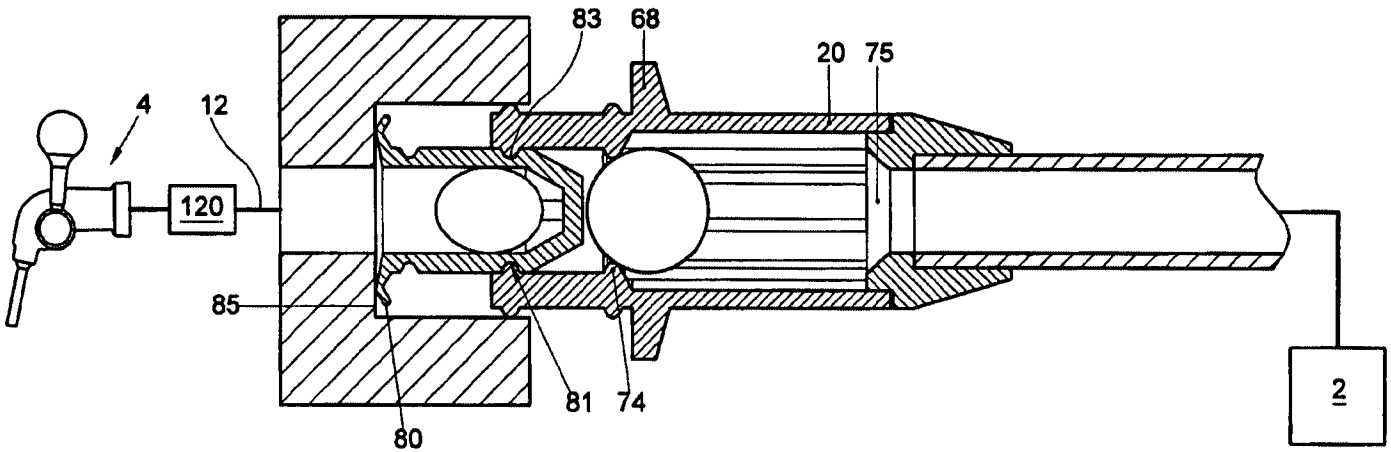
Figure 11C:
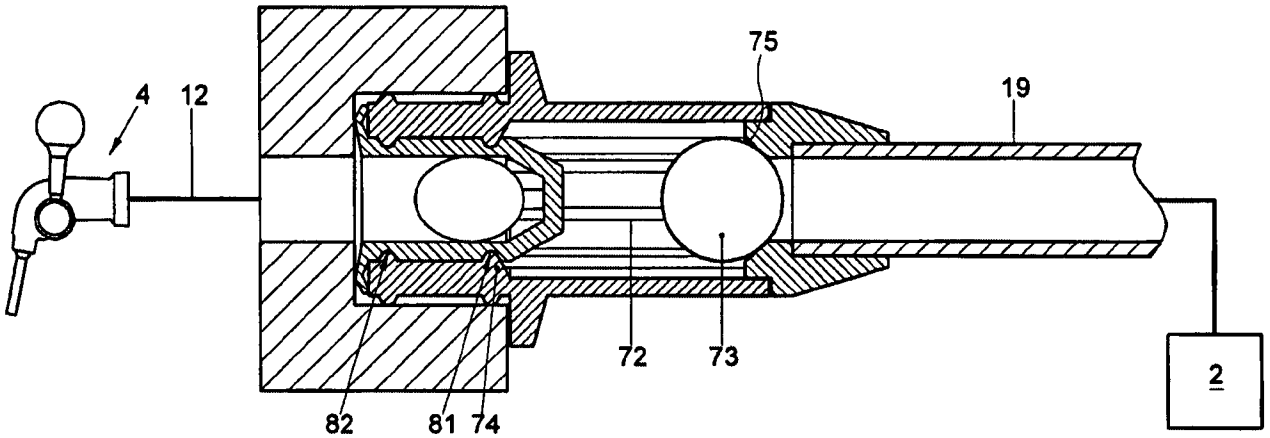
Figure 11D:
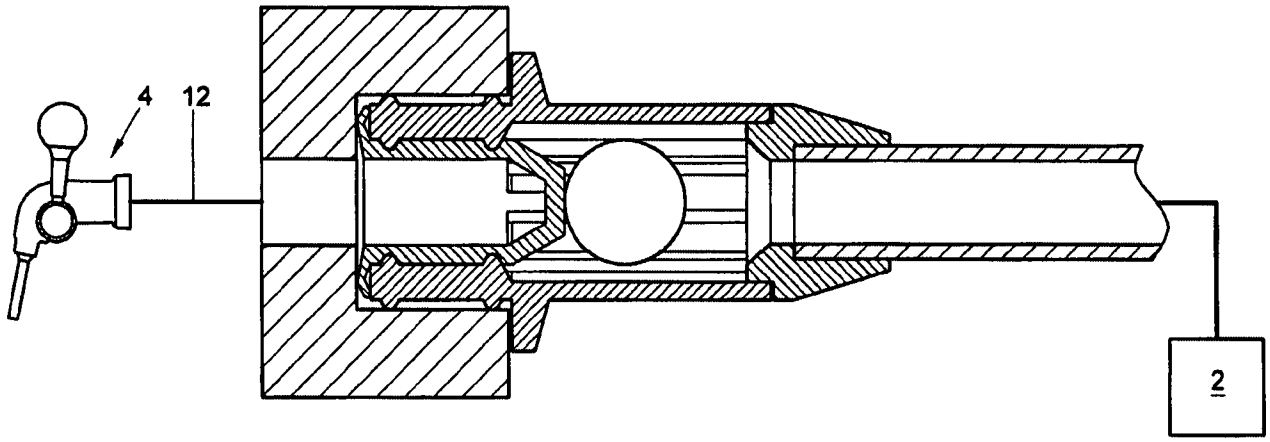

In FIGS. 10 and 11A-D, a possible embodiment of a coupling means 23 is shown. Attached to the hose 19 is a portion 20 such as a housing part, while the hose 19 can be connected directly or indirectly with a beverage container 2 such as a keg or container, BIC or the like. The housing part has a central passage 72 having therein a ball or like closing body 73. The passage 72 is bounded on two opposite sides by a valve seat 74, 75, which can each be closed off by the closing body 73, while the space between the seats 74, 75 is shaped such that the closing body 73 can in principle move freely and at least allows beverage to flow around it when it does not rest against either of the seats 74, 75. To that end, for instance, grooves 76 and/or ribs 77 may be provided on the inner side of the housing part 20. On the side remote from the hose 19, a cage 78 is provided which is movable relative to the housing part 20, into the insertion part 67, while in the cage 78 the cleaning element 21 is provided. The cage 78 has an end 84 partly closed in the direction of the hose 19 and the passage 72, such that the cleaning element 21 cannot escape in that direction, while the closing body 73 cannot enter into the cage and be forced or held off the valve seat 74 by the cage 78. Openings 79 are provided for allowing beverage to pass into and through the cage 78. At the free end, the cage is provided with a flange 80, for instance of a diameter approximately equal to that of the insertion part 67, and is provided with for instance two circumferential grooves 81, 82. On the inner side of the insertion part 67, an annular corrugation 83 is provided, which can snap into one of the grooves 81, 82, depending on the relative position of the cage 78 with respect to the housing part 20. In FIG. 11A a first position of the cage 78 is shown, with the corrugation 83 snapped into the first groove 81. The cage 78 projects partly outside the housing, and the end 84 proximal in the direction of the passage 72 lies on the side of the seat 74 remote from the hose 19. Thus, the closing body 73 can rest sealingly against the seat 74, so that beverage from any beverage container 2 connected to the connecting element 11 and/or beverage from the connecting element 11 itself cannot flow away. In this condition, the insertion part 67 can be inserted in the connecting opening 64, as shown in FIG. 11B, and be pressed further, for instance by pivoting the handle or by manual force, as also described with reference to FIG. 9. When the flange 80 butts against an edge 85 of the connecting opening, around the connection to the tapping line 12, and the housing part 20 is pressed further, the corrugation 83 is forced out of the respective groove 81 and snapped into the second groove 82. The cage thereby enters at least partly through the seat 74, and the closing body 73 is pushed and held off the seat 74. As a result, pressure equalization will occur between the tapping line 12 and the passage 72, specifically when the shutoff 60 is open or is absent. Should any excess pressure prevail in the tapping line and/or any beverage still be present in it, the closing body 73 will thereby be pushed against the other seat 75 and seal against it, as shown in FIG. 11C, so that no beverage can escape from the tapping line. When thereupon beverage is supplied via the hose 19, the shutoff body 73 will be pushed off the seat 75 again (FIG. 11D) by the beverage, and the beverage can flow freely to the tapping line 12. Then the cleaning element 21 will be pressed out of the cage by the beverage and be propelled through the tapping line 12, thereby cleaning it.

FIG. 6 shows an inlay part 46 which can be laid in the tapping cock 4. The inlay part comprises a valve 47 which is operable with the aid of an operating mechanism of the tapping valve 4, as known per se from practice and used by Heineken, Netherlands. Further, the inlay part 46 is provided with third coupling means 48, by which it can be coupled with fourth coupling means 49 at the respective end 50 of the tapping line. In addition, a receiving space 51 is provided for the cleaning element 21. Again, preferably, the third and fourth coupling means 48, 49 are designed for closing off at least the tapping line 12 upon uncoupling thereof, so that no beverage is lost. This means that if the cleaning element 21 arrives in the receiving space 51, the inlay part 46 can be taken out and stripped of the cleaning element and be placed back or replaced by a new inlay element 46. Incidentally, it may also be elected to allow the cleaning element to shoot out of the tapping line directly, without receiving means.

FIG. 12 shows in perspective view an exploded view of a tapping cock 4 with an alternative inlay part 46, which may be a disposable inlay part, intended for single use. The tapping cock 4 comprises a cock housing 90, a cover 91 pivotable relative thereto, an operating handle 92 which can be screwed into an operating disc 93, and a shutoff body 94, in the exemplary embodiment shown in the form of a ball between two valve discs 95 within which the ball 94 is receivable without waste space. Provided in the ball 94 is a passage 96. The ball 94 can be connected via a shaft 97 with the operating disc 93, so that pivoting of the operating handle 92 leads to pivoting of the passage 96. An end piece 98 is provided which can form a connection with the tapping line 12 and a tapping column 13.

Incidentally, it will be clear that also a variety of other types of cocks can be used as shutoff, such as, for instance, a hose cock, pinch cock or other suitable types. Also, automatic valves and/or electrically operable valves can be used.

FIGS. 13A-D show, somewhat diagrammatically and in cross-section, a tapping cock 4 according to FIG. 12, in four different positions. For clarity, the side proximal to the end piece 98 will be referred to as "rear", the side where the inlay part 46 is placed, as "front".

Figure 13A:
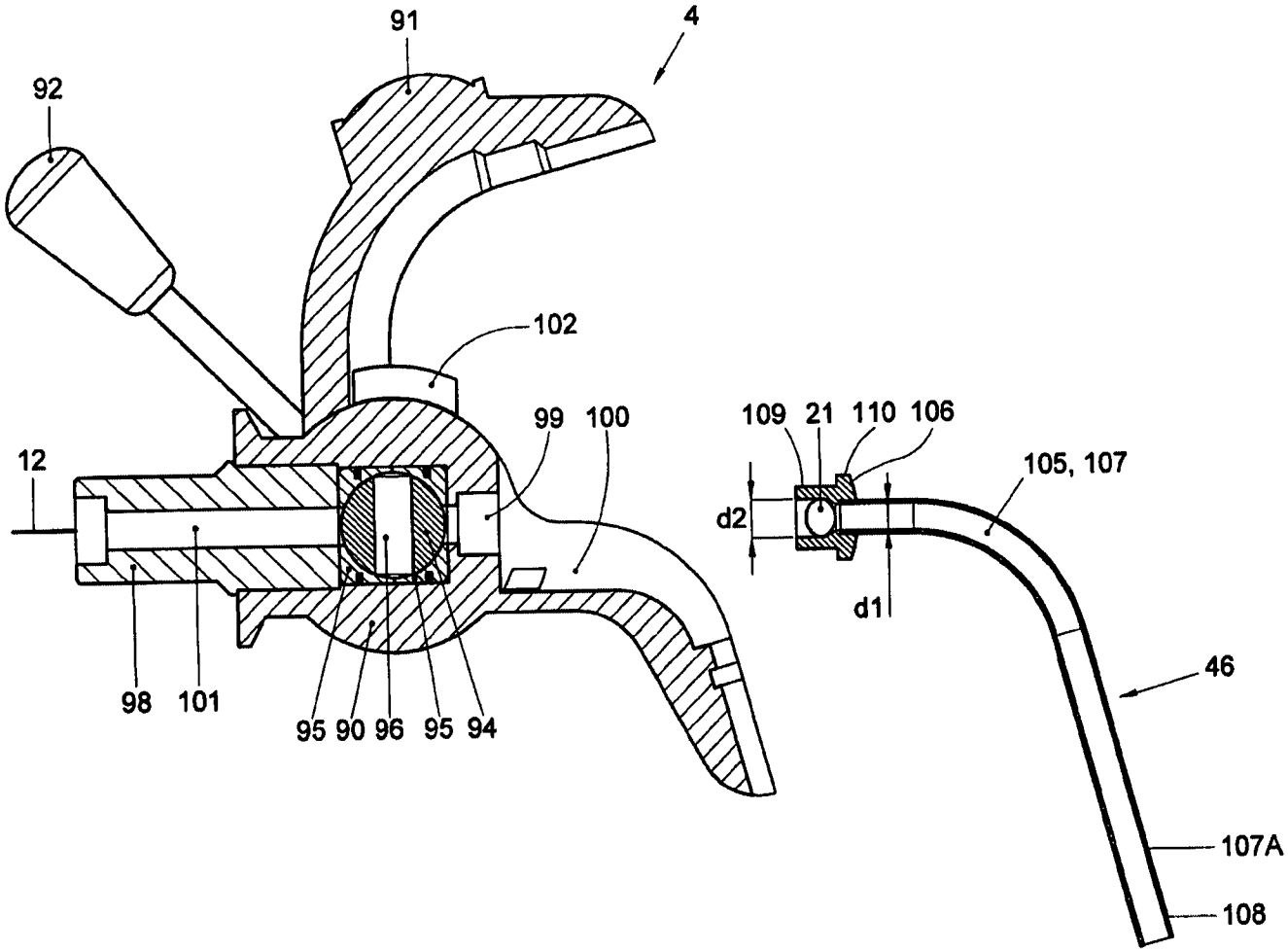

FIG. 13A shows the tapping cock 4 in open position with a loose inlay part 46. The handle is pivoted backwards to a maximum, for instance at an angle of approximately 45 degrees with a vertical line. The cover 91 has been pivoted upwards, thus clearing an insertion opening 99. Frontally under the insertion opening 99, there is a rounded, somewhat channel-shaped part 100 on which an inlay part 46 can come to rest. By pivoting the handle 91 rearwards, the passage 96 has been brought in a vertical position, so that the fluid communication between a passage 101 in the end piece 98 and the insertion opening 99 is broken. On the cover 91, two crests 102 are provided which extend approximately parallel to each other, with a slight interspace which, at right angles to the plane of the paper, has a width approximately corresponding to the thickness of the hose 105 and/or tube 107 of the inlay part 46. The crests 102 in this position are on top of the cock housing 90.

The inlay part 46, here shown as a used inlay part which has just been or is being removed from the tapping cock 4, comprising a connecting collar 106 and a straight and/or bent and/or flexible tube part 107, for instance manufactured from plastic. A run-out end 108 of the tube part 107 may be stiffer than the rest and can for instance be formed by a tube 107A which has been attached to the tube part 107. The connecting collar 106 has an insertion part 109, for instance comparable to that of the first coupling means 23, and a flange 110. In the flange 110, the tube part is secured. Incidentally, the inlay part may also be injection molded in one piece or be composed in a different manner. The inner diameter $d_1$ of the tube part 107 adjacent the flange 110 is less than the inner diameter $d_2$ of the insertion part 109 and has been chosen such that the cleaning element 21 can be pressed into the insertion part 109 by beverage, but not as far as into the tube part 107. The transition of the insertion part 109 to the tube part 107 preferably forms a seat, such that if the cleaning element 21 is pressed against that seat, beverage cannot flow into the tube part 107 anymore.

Figure 13B:
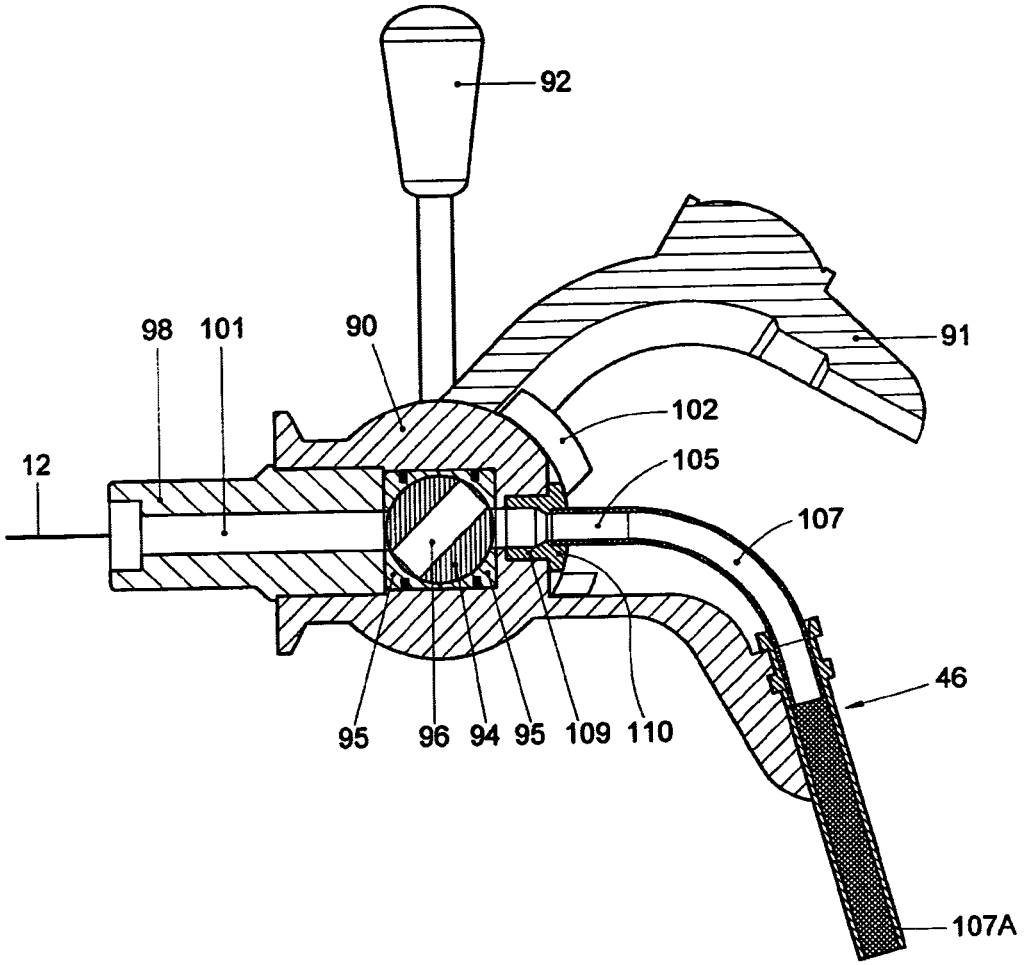

After the inlay part 46 with the cleaning element 21 has been taken out of the tapping cock 4 by pulling the insertion part 109 out of the insertion opening 99, another inlay part 46 can be placed. To that end, the insertion part 109 thereof is pressed into the insertion opening 99, after which, as shown in FIG. 13B, the handle 92 is brought back to a vertical position and the cover is brought to an angle with the vertical, for instance an angle of approximately 45 or 60 degrees. The crests 102 are thereby pressed over the side of the flange 110 remote from the insertion part 109, so that the insertion part 109 is pressed further into the insertion opening 99 and is retained or locked therein.

Figure 13C:
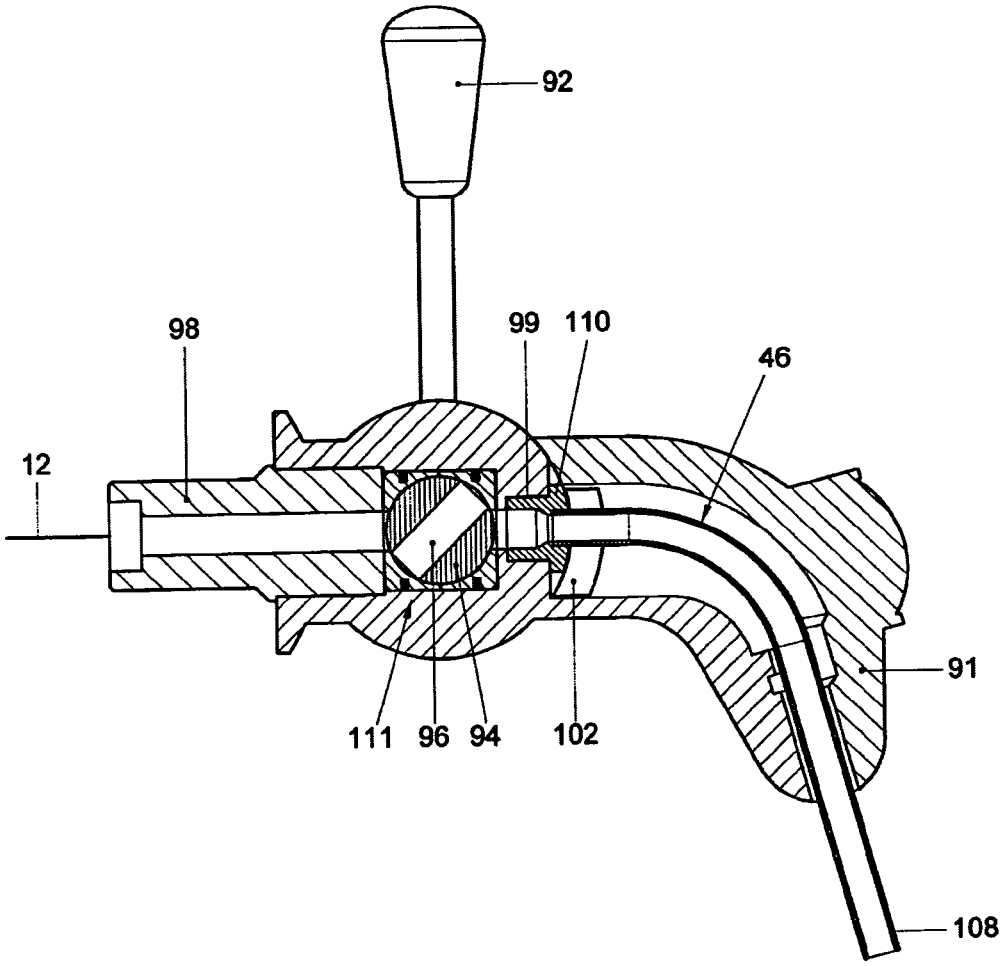
Figure 13D:
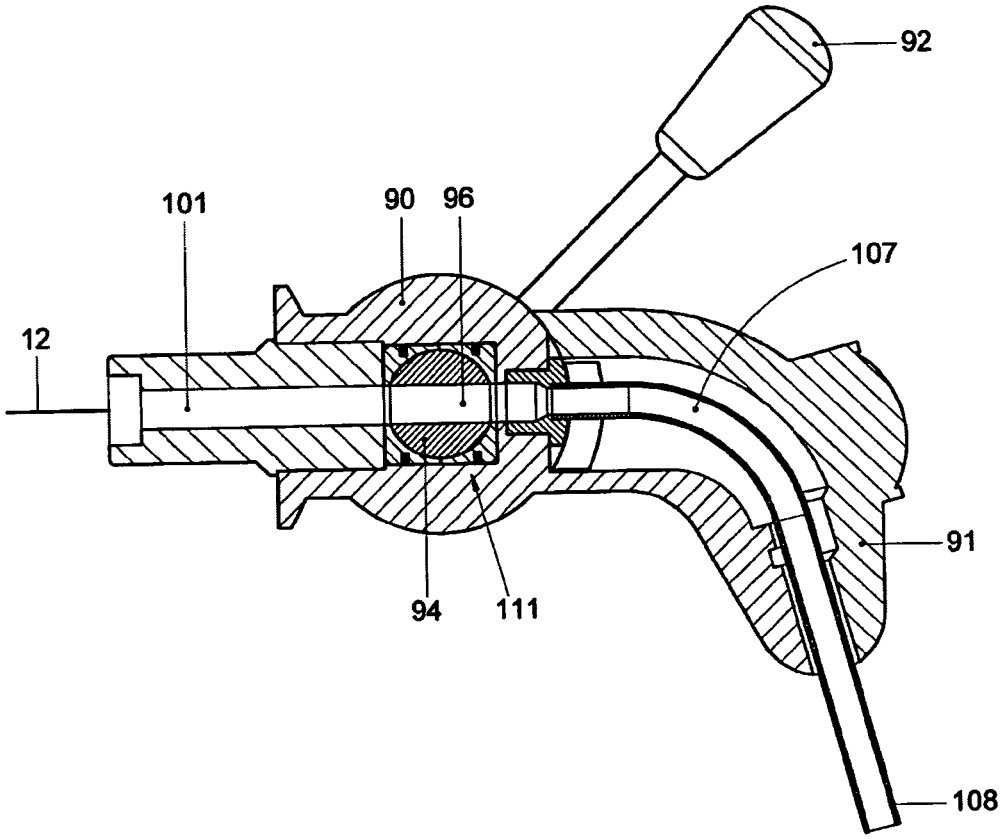

Next, the cover 92 can be pushed further, such that the tapping cock is closed entirely, as shown in FIG. 13C, and is suitable for use. The valve shutoff 111 substantially defined by the closing body 94 is then still closed, so that no fluid communication between the tapping line 12 and the tube part 107 exists.

From the position shown in FIG. 13C, the handle 92 can be pulled further towards the front, for instance to an angle of 45 or 60 degrees with the vertical, so that the ball 94 is rotated further and the passage 96 comes to lie approximately horizontally or at least effects a fluid communication between the tapping line 12 and the tube part 107, so that beverage can be tapped, after which the shutoff 111 can be closed again by moving the handle 92 back up. This tapping action can be repeated each time for so long until the connected beverage container is empty or for any other reason no beverage is to be dispensed from it anymore.

After beer dispensing is stopped, a new or other beverage container can be connected. This can for instance be done as follows. The handle 62 is pivoted so that the passage is closed and the first coupling means 23 can be pulled from the second coupling means 24. Another beverage container with a new connecting element 11 is placed, of which the first coupling means 11 is coupled with the second coupling means 24 in the manner described earlier. Next, for instance by opening a valve 9, 10 of the beverage container, beverage under pressure can be introduced into the first coupling means 23. The cleaning element 21 will thereby sustain the pressure of the beverage. If thereupon the tapping cock 4 is opened, the cleaning element 21 is forced through the tapping line 12, thereby pushing the residual beverage in the tapping line ahead of it. When the cleaning element 21 has been pushed through the tapping cock 4 or at least through the passage 96, it will become jammed against the seat in the insertion part 109. As a result, despite the tapping cock 4 being open, the delivery of beverage is stopped. This is a sign for the user that all beverage from the previous beverage container 2 has been dispensed and that the inlay part 46 can be replaced. To that end, the tapping cock is brought in the position shown in FIG. 13A, the inlay part 46 is exchanged for a new inlay part 46, and the tapping cock is brought back into the position shown in FIG. 13C or D, so that beverage can be tapped from the newly broached beverage container 2.

It will be clear that by the use of coupling means as described by way of example though not exclusively with reference to FIGS. 9-13, the order of connection is not fixed, since, regardless of whether the tapping line is connected first and then the container or the other way around, no beverage can flow away.

In an alternative embodiment, the coupling element 11 may also be designed such that it can be arranged between two parts of an existing tapping line, for instance between a handle dispense head and a tapping line connected thereto, such as a python, while in the coupling element 11 a cleaning element is included which can be shot through the tapping line. In that way, too, a proper cleaning is obtained.

Figure 7B:
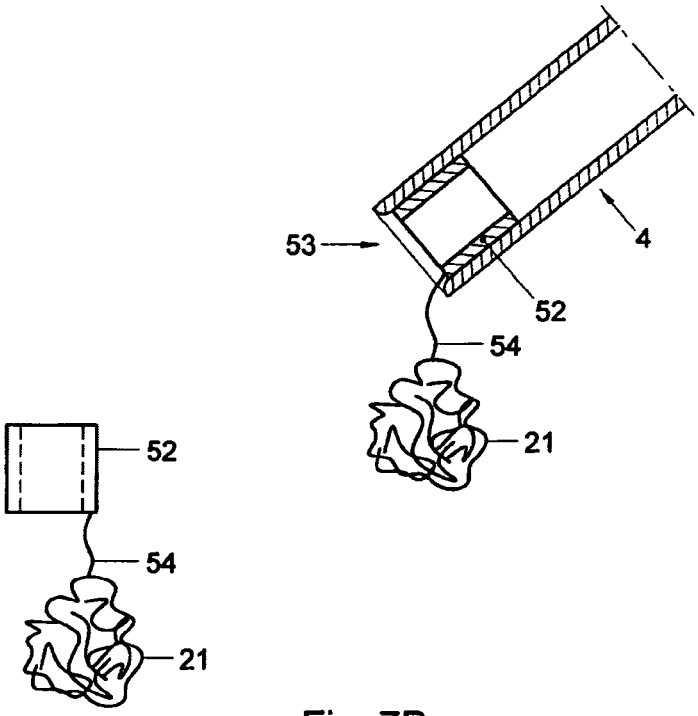

FIGS. 7A and B schematically show two alternative possible embodiments of a cleaning element 21. In FIG. 7A a cleaning element 21 is shown in the form of a small spherical sponge, as known from the prior art. It is for instance manufactured from a flexible plastic such as an elastomer or rubber, with a rough surface. It may be partly porous and may be provided with a coating, as indicated earlier. Optionally, in the cleaning element 21 a cleaning agent may be included, preferably a biological agent. In FIG. 7B a comparable cleaning element 21 is shown, but on an operatively rear side a brake 52 is provided, connected with the cleaning element 21 by an element 54 which may or may not be flexible. As appears from FIG. 7B, the purpose thereof is that if the cleaning element leaves the run-out end 53 of the tapping cock 4, the brake 52 is left behind therein and does not end up in a beverage glass. The user can then simply pull the cleaning element out of the tapping cock by hand.

FIG. 14 shows, in disassembled condition, in sectional side elevation, a regulator 120, in particular a disposable controller, with which a dispensing flow rate can be regulated or at least foaming upon dispensing of gas-containing, for instance carbonated, beverage. This regulator 120 can be placed instead of the inlay part 46 or be combined therewith. This regulator 120 also has an insertion part 109 with a flange 110, with which it can be pressed against the tap housing 90 by means of the crests 102, into the insertion opening 99, as described earlier. In this regulator 120, on the insertion part 109 a housing part 112 is provided with has a somewhat T-shaped passage 113. From the insertion part extends a conical first part 114, widening in flow direction, of the passage 113, which merges into a second portion 115 with inner and/or outer thread 116, which second part 115 is open at the end remote from the first part 114. From adjacent the transition 121 between the first 114 and, situated in line therewith, second part 115 extends, obliquely downwards, a third part 117, for instance comparable to the stiffer part 107A, through which beverage can be dispensed. Into the second part 115, from the open end, a setting screw part 118 with counter thread 122 matching the thread 116 can be screwed, which is provided with a rounded conical end 119. By screwing this farther or less far through the second part 115 into the first part 114, a gap between the inner wall of the first part 114 and the rounded conical part 119 becomes smaller or larger, thus allowing regulation of beverage foaming.

The embodiments of the invention shown are shown only by way of examples and should not be construed as limiting in any way. Many variations thereon, especially also combinations of parts of the embodiments shown, are possible within the framework of the invention outlined by the claims. Further, the coupling element 11 and the connecting device 6 may be integrated. Moreover, multiple cleaning elements may be used, and a coupling element may be replaced more often or less often than per beverage container. The tapping line may be wholly or partly flexible or stiff and may be wholly or partly replaceable. Naturally, a tapping device can also comprise multiple beverage containers and multiple tapping cocks. The invention is particularly suitable for use for carbonated beverage, more particularly beverage with natural ingredients, but can also be used for other beverages. The cleaning element may also be passed into the tapping line by hand, prior to broaching of a beverage container.

The invention claimed is:

1. A tapping device for beverage, comprising at least one beverage container, a tapping line and a tapping cock, wherein the tapping line extends at least to adjacent the tapping cock and connecting means for connection of the tapping line to the at least one beverage container, wherein a cleaning element is provided in the beverage container or the connecting means, wherein the cleaning element at broaching of a beverage container is situated near an end of the tapping line proximal to the beverage container and is movable through the tapping line under pressure of beverage from the beverage container, while abutting against an inside of the tapping line, such that the beverage will propel the cleaning element in the tapping line, at least to near the tapping cock.

2. A tapping device according to claim 1, wherein the cleaning element prior to broaching of the beverage container is included in the connecting means.

3. A tapping device according to claim 1, wherein the beverage container comprises at least one valve assembly for dispensing the beverage, wherein the connecting means comprise a coupling element which at least during use of the beverage container extends between the valve assembly and the tapping line, wherein the coupling element comprises the cleaning element prior to broaching of the beverage container.

4. A tapping device according to claim 3, wherein the coupling element is coupled with the beverage container, such that the coupling element can be supplied and/or discarded along with the beverage container and upon detachment of the connecting means remains connected with the beverage container.

5. A tapping device according to claim 3, wherein the coupling element is arranged for operating at least a part of the valve assembly.

6. A tapping device according to claim 1, wherein the cleaning element is provided in or at a valve assembly of the beverage container.

7. A tapping device according to claim 1, wherein the cleaning element prior to broaching of the beverage container is provided in or at the tapping line.

8. A tapping device according to claim 1, wherein the tapping line is provided with closing means which prevent flow of the beverage through the tapping line in the direction of the beverage container, at least with the connecting means and/or the tapping line detached from the beverage container.

9. A tapping device according to claim 1, wherein the cleaning element is at least partly flexible.

10. A tapping device according to claim 1, wherein a coupling element is provided which prior to connection of the beverage container is positioned at a valve assembly thereof and comprises a beverage passage, wherein in or at the beverage passage the cleaning element is provided, such that upon coupling of the beverage container with the tapping line said beverage passage is included between a beverage valve of said valve assembly and the tapping line and upon opening of the valve assembly the beverage flows from the beverage container into the beverage passage and thereby presses the cleaning element into and through the tapping line.

11. A tapping device according to claim 10, wherein the coupling element comprises a collar which in coupled condition of the coupling element and the tapping line extends partly in or against the tapping line.

12. A tapping device according to claim 1, wherein the cleaning element is provided with retaining means which get jammed in or near a second end and are connected with the cleaning element, such that the cleaning element can be pressed out of the tapping line, through the second end, and is retained by said retaining means.

13. A tapping device according to claim 1, wherein the tapping cock is arranged for catching and/or allowing removal of the cleaning element from the tapping line.

14. A tapping device according to claim 9, wherein the cleaning element is non-moisture transmissive.

15. A tapping device according to claim 10, wherein the coupling element comprises a collar which in coupled condition of the coupling element and the tapping line extends partly in or against the tapping line and abuts against an inner side thereof.

16. A coupling element comprising a beverage passage, wherein in or at the beverage passage a cleaning element is provided which during use can be pressed from said coupling element into a tapping line fluidly coupled to the beverage passage by beverage introduced into the beverage passage from a beverage container connected therewith and is movable through the tapping line under pressure of beverage from the beverage container, while abutting against an inside of the tapping line, such that the beverage will propel the cleaning element in the tapping line, at least to near a tapping cock and the cleaning element will clean the inside of the tapping line while being propelled through the tapping line.

17. A beverage container provided with a valve assembly for dispensing a beverage, wherein near the valve assembly a cleaning element is provided in a beverage passage, such that upon opening of the valve assembly, the beverage is introduced from the beverage container into the beverage passage, thereby moving the cleaning element away from the valve assembly, wherein a coupling element is provided which has been positioned prior to broaching of the beverage container and comprises the beverage passage, such that upon coupling of the beverage container with a tapping line of a tapping device, said beverage passage is included between a beverage valve of said valve assembly and the tapping line and upon opening of the valve assembly the beverage flows from the beverage container into the beverage passage and thereby presses the cleaning element into and through the tapping line.

18. A method for the use of a tapping device, wherein a beverage container, using a connecting device, is coupled with a tapping line, wherein upon coupling of the connecting device with the beverage container a coupling element with a beverage passage is included between the inner space of the beverage container and the tapping line, wherein a cleaning element which during coupling extends in or adjacent said coupling element, after opening of a beverage valve of the beverage container is pressed by beverage from the beverage container into and through said tapping line and is taken away at an end of the tapping line.

19. A method according to claim 18, wherein said coupling element is included between said beverage valve and the tapping line.

20. A method according to claim 18, wherein the coupling element is detachably connected with the beverage container, for coupling with the connecting device and upon detachment of the connecting device from the beverage container remains behind on and/or in the beverage container.

21. A method according to claim 18, wherein the coupling element is supplied with the beverage container for said coupling.

22. A method according to claim 18, wherein the coupling element is supplied with the beverage container for said coupling and is discarded with the beverage container.

23. A method for the use of a tapping device with which beverage containers are emptied, wherein upon broaching of a beverage container a cleaning element is introduced into a tapping line on a side proximal to the beverage container, wherein the cleaning element is thereupon pressed through the tapping line by beverage from said beverage container, such that the cleaning element cleans an inside of the tapping line while being pressed through the tapping line.

24. A beverage container provided with a valve assembly for dispensing a beverage, wherein near the valve assembly a cleaning element is provided in a beverage passage, such that upon opening of the valve assembly, the beverage is introduced from the beverage container into the beverage passage, thereby moving the cleaning element away from the valve assembly through a tapping line connected to the beverage passage, wherein the cleaning element is movable through the tapping line under pressure of the beverage from the beverage container, while abutting against an inside of the tapping line, such that the beverage will propel the cleaning element in the tapping line, at least to near a tapping cock and the cleaning element will clean the inside of the tapping line.

* * * * *